US010925121B1

(12) United States Patent
Pacholok

(10) Patent No.: US 10,925,121 B1
(45) Date of Patent: Feb. 16, 2021

(54) HAND HELD INDUCTION HEATER AND VARIOUS TRANSFORMER EMBODIMENTS THEREFOR

(71) Applicant: David R. Pacholok, Sleepy Hollow, IL (US)

(72) Inventor: David R. Pacholok, Sleepy Hollow, IL (US)

( * ) Notice: Subject to any disclaimer, the term of this patent is extended or adjusted under 35 U.S.C. 154(b) by 218 days.

(21) Appl. No.: 15/936,304

(22) Filed: Mar. 26, 2018

Related U.S. Application Data

(63) Continuation-in-part of application No. 15/044,754, filed on Feb. 16, 2016, now abandoned.

(51) Int. Cl.

| | |
|---|---|
| ***H05B 6/04*** | (2006.01) |
| ***H01F 38/20*** | (2006.01) |
| ***H01F 27/08*** | (2006.01) |
| ***H01F 27/28*** | (2006.01) |
| ***H01F 27/24*** | (2006.01) |

(52) U.S. Cl.
CPC ..... *H05B 6/04* (2013.01); *H01F 27/08* (2013.01); *H01F 27/24* (2013.01); *H01F 27/28* (2013.01); *H01F 38/20* (2013.01)

(58) Field of Classification Search
CPC . H05B 6/04; H05B 6/10; H05B 6/105; H05B 6/14; H05B 6/36; H01F 27/24; H01F 27/28; H01F 27/2823; H01F 27/2847; H01F 27/324; H01F 27/325; H01F 27/346; H01F 27/362; H01F 27/365; H01F 27/40
USPC ..... 219/600, 615, 616, 617, 633, 635, 653, 219/660–662, 670, 672; 336/62, 84, 150, 336/155, 170, 178, 183, 184, 192, 198, 336/212, 220, 226
See application file for complete search history.

(56) References Cited

U.S. PATENT DOCUMENTS

| | | | | |
|---|---|---|---|---|
| 4,017,701 A * | 4/1977 | Mittelmann | H01F 5/00 219/660 |
| 5,122,947 A * | 6/1992 | Hishiki | H01F 27/346 336/178 |
| 5,764,500 A * | 6/1998 | Matos | H02M 7/48 363/17 |
| 2003/0121909 A1* | 7/2003 | Riess | B23K 13/01 219/633 |
| 2012/0248093 A1* | 10/2012 | Ulrich | H02G 1/128 219/600 |

* cited by examiner

*Primary Examiner* — Hung D Nguyen
(74) *Attorney, Agent, or Firm* — Kajane McManus; Jeanette M. Braun; Braun IP Law, LLC

(57) ABSTRACT

The handheld, self contained, air cooled induction heater which engages an A.C. power source, a rectifier to convert A.C. to D.C., an inverter which converts the D.C. to A.C. operating at substantially higher frequency than the A.C. power line frequency, a high frequency step-down transformer having magnetic cores, wherein at least a primary winding is split into two parts which are each wound around one of two suitable structures such as legs of the transformer magnetic core, and a secondary winding being connected to heat dissipating terminals functionally engaged to a work coil.

Figure 1:
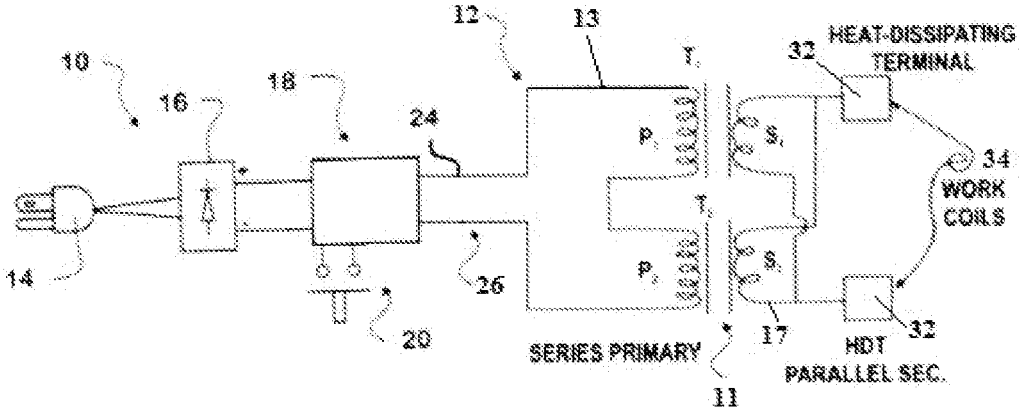

The transformer for the induction heater has a primary and secondary wound around two suitable structures such as both legs of a magnetic core to reduce leakage inductance and increase power output compared to the primary and secondary windings of the same number of turns all wound on one leg of the magnetic core.

8 Claims, 4 Drawing Sheets

HAND HELD INDUCTION HEATER AND VARIOUS TRANSFORMER EMBODIMENTS THEREFOR

I. CROSS REFERENCE TO RELATED APPLICATION

This application is a continuation-in-part of U.S. application Ser. No. 15/044,754 filed on Feb. 16, 2016, and entitled "Hand Held Induction Heater and Transformer Therefor", the teachings of which are incorporated by reference in their entirety.

II. FIELD OF THE INVENTION

This invention relates to air cooled, self contained, handheld induction heaters used to heat rusted nuts and bolts for removal thereof such as for repair of machinery, automobiles, trucks, rails, chemical plants, petrochemical, etc. Such handheld induction heaters are totally self-contained; that is, they are air cooled and include a high frequency inverter. One end of the tool has a power connecter for connection to utility power, i.e. 120 or 240 VAC, and the other end has attachment terminals for a variety of work coils. This variety of work coils allows efficient heating of different sized nuts, bolts and the like needed in industrial, automotive or other equipment disassembly and/or repair. Other uses for such handheld induction heating equipment include expanding bearing races or housings for bearing removal/replacement, and even annealing metals such as brass shells in firearms ammunition reloading procedures.

Prior Art

Historically, such hand held induction heaters have been limited to a power of about 1000 watts. The reason for this is the limited volume and physical constraints in a handheld tool. A generally cylindrical shape for such tools is preferred allowing ergonomic compatibility with the human hand. As such, the gripping section of the tool is limited to no more than a 3" diameter, and preferably less. Length is limited for operator ease of use, as are balance and weight. These physical constraints result in the power limitation of about 1000 watts for all handheld, self contained induction heaters on the market. It would be very desirable to increase this power limitation so that small nuts and bolts and the like can be heated more quickly, and larger nuts and bolts, etc. can be heated sufficiently for expansion and thus easy removal.

III. SUMMARY OF THE INVENTION

According to the invention there is provided a handheld, self contained, air cooled induction heater including an input connector for engaging a source of A.C. power, a rectifier to convert A.C. to D.C., an inverter which converts the D.C. to A.C. operating at substantially higher frequency than the A.C. power line frequency, one or more high frequency step-down transformers having magnetic cores which are of various embodiments and being connected to heat dissipating terminals capable of functional engagement to at least one work coil.

IV. BRIEF DESCRIPTION OF THE DRAWINGS

FIG. 1 presents a schematic view of an induction heater comprising, from left to right, a power input connector, a rectifier, an inverter or power supply circuit with momentary switch control, and a first transformer configuration to be described below and heat dissipating terminal connections for a work coil.

Figure 2:
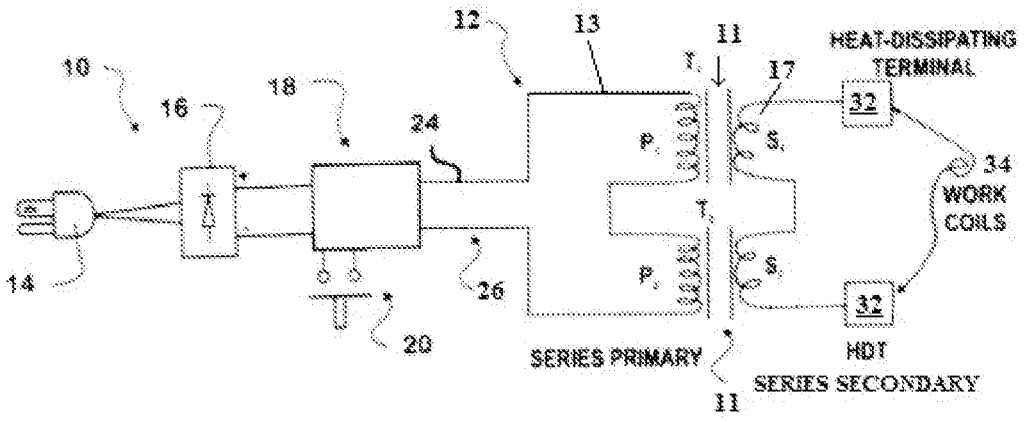

FIG. 2 presents a schematic view of an induction heater comprising, from left to right, a power input connector, a rectifier, an inverter or power supply circuit with momentary switch control, and a second transformer configuration to be described below and heat dissipating terminal connections for a work coil.

Figure 3:
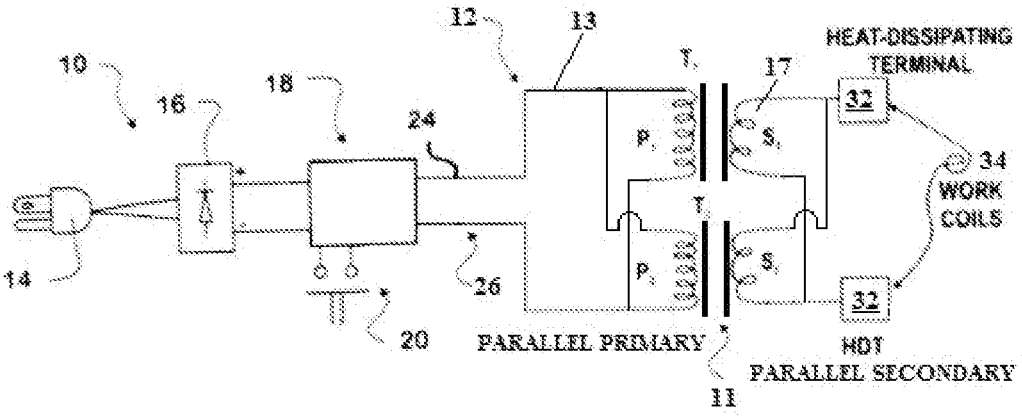

FIG. 3 presents a schematic view of an induction heater comprising, from left to right, a power input connector, a rectifier, an inverter or power supply circuit with momentary switch control, and a third transformer configuration to be described below and heat dissipating terminal connections for a work coil.

Figure 4:
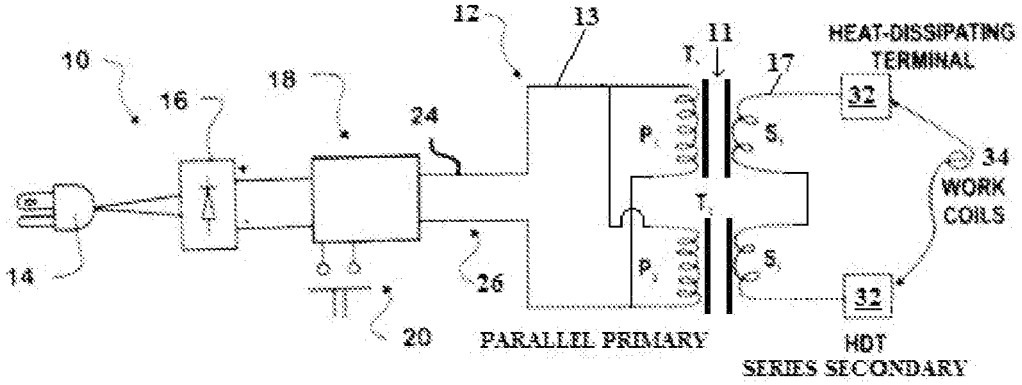

FIG. 4 presents a schematic view of an induction heater comprising, from left to right, a power input connector, a rectifier, an inverter or power supply circuit with momentary switch control, and a fourth transformer configuration to be described below and heat dissipating terminal connections for a work coil.

V. DESCRIPTION OF THE PREFERRED EMBODIMENTS

As will become clearer after a thorough perusal of this application, three main principles of electronics are applicable to the invention as listed below.

Resistance of Each Winding

Rp or Rs=MLT*Rcu*N where: Rp=Primary Winding Resistance Rs=Secondary Winding

Resistance Rcu=Copper Resistance (μΩ/cm) N=Turn Count

Temperature Rise Estimate $\Delta T=(P\Sigma/At)^{0.833}$ where: ΔT=Temperature Rise in ° C. PΣ=Total Transformer Losses in mW/cc (Power dissipated in the form of heat) At=Surface Area of Transformer in $cm^2$ Creation of the Exponent in the Temperature Rise Formula $$x=\ln(P\Sigma@1^{st}\,\Delta T/P\Sigma@2^{nd}\,\Delta T)/\ln(1^{st}\,\Delta T/2^{nd}\Delta T)$$

The need for the transformer embodiments of the present invention is two-fold. First, the high frequency inverter within these devices operates at power line voltages, typically 100-240 volts, necessitated by their direct connection to standard power line voltage supplies. The work coils in contrast, operate at several 10's of volts and high current to allow for a small, practical number of work coil turns, typically 1 to 5 turns, of heavy gauge wire. The one or more transformers "match" the high voltage, low I inverter to the low voltage, high current work coil. Second, the high frequency one or more transformers galvanically isolate the dangerous high voltage from the power line-connected inverter from the user-accessible work coil.

Due to the dimensional constraints of the handheld, self contained induction heater, especially the maximum diameter comfortable for the human hand, the transformer design choices are limited and a set of 2 windings is needed to complete a transformer.

For example, the temperature rise of the conventional transformer was compared to that of the new transformer embodiments. The same work coil consisting of two turns of #8 AWG wire, loaded by a 1.5" diameter mild steel pipe was used to test temperature rise of both transformers. The A.C. input voltage was 120.0 VAC in both cases. Starting temperature was 30° C. in all cases. Temperature was measured by type K thermocouples and yielded results as shown in the following table.

It was discovered that the temperature rise for the transformer embodiments of the present invention was considerably lower, as expected. An unexpected result was the 250-300 watt increase in measured power. The number of turns on the prior art and present transformer embodiments was the same, 30 turns primary and 4 turns secondary. It was determined that the reason for the increased power was due to the vastly reduced primary to secondary leakage inductance in the instant

| | T, ° C. | Power Watts | T, ° C. | Power |
|---|---|---|---|---|
| 1 minute | 39 | 938 | 45 | 1242 |
| 2 minutes | 88 | 942 | 58 | 1250 |
| 3 minutes | 113 | 957 | 75 | 1258 |
| 4 minutes | 137 | 969 | 92 | 1263 |
| 5 minutes | 156* | 981 | 113 | 1268 |
| 10 minutes | — | — | 149 | 1282 |

*Exceeds 150° C. temperature rating of insulation transformer embodiments. Leakage inductance may be approximately measured by shorting the secondary and measuring the primary inductance. A perfect transformer, having zero leakage, would measure zero micro-Henries with its secondary shorted. Real transformers have finite leakage inductance. Leakage inductance acts as a series impedance with the load, reducing current, voltage and therefore power to the load. Prior art transformer showed 13.2 μH leakage inductance, while the instant transformer embodiments only showed 5.3 μH, explaining the increased power.

The lower leakage inductance and lower temperature rise are very desirable results. The new transformer embodiments deliver ⅓ more power for twice the time before overheat. The improved induction heater using the disclosed transformer embodiments is therefore capable of heating larger nuts, bolts and metallic objects to a given temperature in shorter time, or heating large objects to a higher temperature before transformer thermal limitations are reached.

Inasmuch as the core and legs thereof of the transformer 12 are clearly shown and described in the pending parent application, for the sake of simplicity which one in the art would grasp instantly, they are left out of the figures herein and the variety of combinations of primary and secondary windings are shown independent of the legs of the core about which they are wound.

VI. DESCRIPTION OF THE PREFERRED EMBODIMENTS

As illustrated in FIGS. 1-4, all the embodiments of the newly devised transformer 12 of the present invention are shown incorporated into a handheld induction unit 10. As illustrated, going from left to right, a power input connector 14 connects to an alternating current power source (not shown). Rectifier 16 converts the alternating line current from power source input connector 14 into a high voltage direct current which energizes the power supply circuit 18. The power supply circuit 18 comprising inverter 18 converts the rectified direct current into high frequency, high voltage alternating current when the momentary switch control 20 is closed.

Next shown are the transformer 12 embodiments of the present invention wherein winding half of the turns of the primary and secondary winding 24 and 26, respectively, on a first leg (not shown) and half on a second leg (not shown) leads to dramatic reductions in peak winding temperature, for a given power transferred, and thus much higher power output capability at greater duty cycle. The legs upon which the windings are wound are not shown for the sake of simplicity, as they are already defined in the parent case, the teachings of which are incorporated herein, The herein below descriptions of the transformer 12 embodiments only describe modifications to the right of reference numeral 12 in the figures.

Beginning with FIG. 1 a cross sectional view through an air gap 11 of one of the one or more transformers 12 which may be used in the present invention and is illustrated with a primary winding 13 wound in a series embodiment, and a secondary winding 17 being wound in a parallel embodiment.

FIG. 2 presents a cross sectional view through an air gap 11 of one of the one or more transformers 12 which may be used in the present invention and is illustrated with a primary winding 13 and a secondary winding 17 both being wound in a series embodiment.

FIG. 3 presents a cross sectional view through an air gap 11 of one of the one or more transformers 12 which may be used in the present invention and is illustrated with a primary winding 13 and a secondary winding 17 both being wound in a parallel.

FIG. 4 presents a cross sectional view through an air gap 11 of one of the one or more transformers 12 which may be used in the present invention and is illustrated with a primary winding 13 wound in a parallel configuration and a secondary winding 17 being wound in a series configuration.

The descriptions of the modifications made to the windings of the at least one transformer 12 of the present invention are not very complex but are extremely beneficial for use in their ambient environment and do not require much in the way of description as those skilled in the art would understand immediately the workings of the much improved high frequency step down transformers 12 of the present invention. It will also be understood by those skilled in the art that the windings 13 and 17 may be of more than one part into which they may be split, as necessary.

Next the secondary windings 26 are each connected to corresponding heat dissipating terminals 32 which are also capable of functional engagement to a work coil 34 which allow various work coils 34 to be installed, depending on the application of the device. Finally the work coil 34 converts high frequency high current alternating current into a high frequency alternating magnetic field which heats a metallic or conductive object (not shown) which is placed within the magnetic flux lines emanating from the work coil 34. Here it will be understood by those skilled in the art how the above equations were applied to create any one of the plurality of disclosed embodiments of the transformer 12 of the present invention.

It will be appreciated by those skilled in the art that the single dual legged transformers described above are electrically similar to two transformers electrically interconnected also as described above. Such a prototype set was built and tested. Two sets of ETD-44 cores, available as part number 44-00-00 from Ferrite International were used to construct two transformers. Such a transformer has a maximum dimension of 2.25 inches and fits easily within a case with an inside diameter of 2.4 inches. The primary winding of each consisted of 15 turns of 150×#36 AWG Litz wire, single layer wound. These two 15 turn primary windings were interconnected in series, effectively providing 30 turns total. The secondary windings were each wound over the primary and consisted of 4 turns each of 420×#36 AWG Litz wire, and were interconnected in parallel. The cores in both interconnected transformers were gapped to 0.030 inch.

Testing at 120.0 VAC input to the induction heating inverter using the same workcoil/load as above yielded the following results:

At 5 Minutes: Power=1210 watts, temperature=110 C

At 10 Minutes: Power=1225 watts, temperature=145 C

The starting temperature was again 30 C.

The somewhat lower power of this embodiment was attributed to the slightly higher leakage inductance of the two transformer combination which measured 6.8 microhenrys as opposed to 5.3 uH in the single transformer dual winding embodiment. Leakage inductance was measured by shorting the parallel connected four turn windings and measuring the leakage inductance across the series connected primary turns, totaling thirty turns.

The lower temperature rise of another exemplary two transformer embodiment is attributed to the two transformers having more surface area for heat dissipation. The use of more than two transformers would increase this area farther at the expense of electrical and mechanical complexity As described above, the induction heater 10 of the present invention provides a number of advantages, some of which have been described above and others of which are inherent in the invention. Further, modifications may be proposed without departing from the teachings herein. Accordingly the scope of the invention should only be limited as necessitated by the accompanying claims.

The invention claimed is:

1. A handheld, self contained, air cooled induction heater including an input connector for engaging a source of A.C. power, a rectifier to convert A.C. to D.C., an inverter which converts the D.C. to A.C. operating at substantially higher frequency than the A.C. power line frequency, a high frequency stepdown power transformer having magnetic cores incorporating two structures, wherein at least a primary winding of the high frequency step down power transformer is split into two substantially equal parts, each part being wound around only one of two structures of the transformer magnetic core, and wherein a secondary winding is connected to heat dissipating terminals capable of functional engagement to at least one work coil.

2. The induction heater of claim 1, wherein the secondary winding of the high frequency step down power transformer is split into two substantially equal parts, each part being wound around one structure of the transformer magnetic core.

3. The induction heater of claim 2 wherein the secondary winding parts are connected in series.

4. The induction heater of claim 2 wherein the secondary winding parts are connected in parallel.

5. The induction heater of claim 1 wherein the two parts of the primary windings are connected in series.

6. The induction heater of claim 1 wherein the two parts of the primary windings are connected in parallel.

7. A transformer for a handheld, self contained, air cooled induction heater having a primary winding and a secondary winding, each winding being split into two parts and having one part thereof wound around a suitable structure of a magnetic core so that leakage inductance is reduced and power output increased as compared to the primary windings and secondary windings of the same number of turns all being wound around only one suitable structure of the magnetic core.

8. In a handheld, self contained, air cooled induction heater, the improvement comprising a step down power transformer having primary and secondary windings suitably wound around a suitable structure of a magnetic core so that leakage inductance is reduced and power output increased compared to the primary and secondary windings of the same number of tums all wound only around suitable structure of a magnetic core, where the decrease in temperature rise in the high frequency transformer is calculated through use of equations:

Resistance of Each Winding $Rp$ or $Rs=MLT*Rcu*N$ where: $Rp$=Primary Winding Resistance $Rs$=Secondary Winding Resistance $Rcu$=Copper Resistance (pQ/cm) $N$=Turn Count;

$\Delta T=(P\Sigma/At)^{0.833}$ where: $\Delta T$=Temperature Rise in ° C. $P\Sigma$=Total Transformer Losses in mW/cc (Power dissipated in the form of heat) At=Surface Area of Transformer in cm2; and Creation of the Exponent in the Temperature Rise Formula $$x=\ln(P\Sigma@1^{st}\ \Delta T/P\Sigma@2^{nd}\ \Delta T)/\ln(1^{st}\ \Delta T/2^{nd}\ \Delta T).$$

* * * * *